United States Patent [19]

Yoshioka et al.

[11] Patent Number: 4,885,215

[45] Date of Patent: Dec. 5, 1989

[54] ZN-COATED STAINLESS STEEL WELDED PIPE

[75] Inventors: Keiichi Yoshioka; Kenji Watanabe; Yasushi Kato, all of Chiba, Japan

[73] Assignee: Kawasaki Steel Corp., Tokyo, Japan

[21] Appl. No.: 102,024

[22] Filed: Sep. 29, 1987

[30] Foreign Application Priority Data

| | | | |
|---|---|---|---|
| Oct. 1, 1986 | [JP] | Japan | 61-233500 |
| Dec. 5, 1986 | [JP] | Japan | 61-290034 |
| May 25, 1987 | [JP] | Japan | 62-127637 |

[51] Int. Cl.[4] ..... F16L 9/02

[52] U.S. Cl. ..... 428/632; 138/143; 138/146; 138/171; 428/659

[58] Field of Search ..... 428/653, 659, 632; 138/143, 145, 146, 171

[56] References Cited

U.S. PATENT DOCUMENTS

| | | | |
|---|---|---|---|
| 2,817,364 | 12/1957 | Crawford | 138/171 |
| 3,201,211 | 8/1965 | Renshaw et al. | 428/659 |
| 3,536,459 | 10/1970 | Bates | 428/653 |
| 3,556,745 | 1/1971 | Zaremski | 428/653 |
| 3,637,354 | 1/1972 | Zaremski | 428/653 |
| 3,830,634 | 8/1974 | Zaremski et al. | 428/653 |
| 4,079,157 | 3/1978 | Yagi et al. | 428/653 |
| 4,672,007 | 6/1987 | Teng et al. | 428/659 |

FOREIGN PATENT DOCUMENTS

| | | | |
|---|---|---|---|
| 26177 | 2/1982 | Japan | 138/146 |
| 50-195 | 3/1985 | Japan | 428/659 |
| 2080827 | 10/1982 | United Kingdom . | |

*Primary Examiner*—Robert McDowell
*Attorney, Agent, or Firm*—Austin R. Miller

[57] ABSTRACT

An exterior stainless steel sheet is provided comprising a stainless steel substrate and a coating layer formed on one surface of the steel substrate from Al, Al alloy, Zn or Zn alloy to a thickness of 0.1 to 70 μm, preferably 1 to 70 μm. A Zn or Zn-Ni alloy plated stainless steel strip is prepared by degreasing a stainless steel strip, substantially activating the surface of the strip, and electroplating the strip in a zinc or zinc-nickel alloy plating bath at pH 3.5 or lower. During electroplating of one side, the other side of the strip not to be plated is covered with a protective film. A stainless steel sheet comprising a stainless steel substrate and a coating layer formed on one surface of the steel substrate from Zn or Zn alloy to a thickness of 0.1 to 50 μm, preferably 1 to 50 μm is useful in preparing welded pipes.

7 Claims, 3 Drawing Sheets

MANUFACTURE OF ONE-SIDE Zn PLATED STAINLESS STEEL STRIP

ZN-COATED STAINLESS STEEL WELDED PIPE

BACKGROUND OF THE INVENTION

This invention relates to stainless steel sheets useful as exterior members having improved workability and weatherability on uncoated surface thereof, and their processes for making the same. It also relates to pipe-making stainless steel sheets having improved corrosion resistance and workability at weld joints.

Exterior members as typified by exterior building panels and automotive exterior members such as bumpers and side moldings are often made of stainless steel because aesthetic appearance and weatherability are required. Useful stainless steels are SUS 434, SUS 304 and stainless steels having improved corrosion resistance due to Nb and Cu added in combination.

Steel material from which welded pipes are prepared must itself exhibit corrosion resistance, workability and weldability. Since welded pipes prepared therefrom are often subjected to severe working, the welded pipes themselves are required to have improved corrosion resistance and workability at weld joints. Typical of the material which is conventionally used to make welded pipes such as automobile exhaust gas conduits/pipes is aluminized steel comprising a cold rolled steel substrate having aluminum hot dipped at high temperatures (see Japanese Patent Application Kokai No. 60-152663).

Environment pollution becomes more serious in these years. The environment is now more corrosive as by acid rain particularly in Europe and North America. In addition, rock salt is often dispersed in winter on the road to prevent freezing. Because of these factors, the environment becomes more severe which exterior members like automotive bodies and exterior building members and welded pipes like automotive exhaust gas conduits must withstand. Even the above-mentioned stainless steel sheets used as exterior members suffer from the problem that their appearance is impaired by rust or stain formation. There is a need for the development of highly corrosion resistant stainless steel sheets having improved weatherability.

In general, for the purpose of improving the corrosion resistance of stainless steel, it is known to increase the content of chromium or further add molybdenum. Unfortunately, these approaches not only add to the cost of stainless steel, but result in reduced workability, rendering difficult press forming into a complicated shape.

Stainless steel sheets are used as automobile exterior members such as side moldings, body locker panels, wheel arch moldings, and bumpers. The body to which these exterior members are attached is electrochemically less noble or lower in electrochemical series than stainless steel. Thus the body undergoes galvanic corrosion and eventually cosmetic corrosion in that a lacquer coating is broken to adversely affect the aesthetic appearance.

One known corrosion resistant stainless steel sheet which can prevent the cosmetic corrosion of the associated body and is of light weight is a cold rolled aluminum clad stainless steel sheet as disclosed in Japanese Patent Publication No. 47-19853. The aluminum which is electrochemically less noble than ordinary steel intervenes between the body-forming ordinary steel and exterior decorative stainless steel. The aluminum provides for sacrificial corrosion prevention, preventing the cosmetic corrosion of the body.

Such clad stainless steel has the problem that it cannot be press formed into a complicated shape because stainless steel is hardened during cladding of stainless steel with aluminum by cold rolling and cannot be softened by annealing in a temperature range below the melting temperature of aluminum (660° C.). Cladding under pressure contact by cold rolling tends to introduce flaws on the surface of stainless steel sheet to be used as an exterior surface. Buffing is thus necessary to eliminate such flaws so that the product becomes very expensive.

It is often desirable in view of productivity to mount exterior members to the automobile body at some feasible positions by spot welding. In preparing the above-mentioned cold rolled aluminum clad stainless steel, a higher cladding ratio of aluminum must be employed because of cold roll cladding conditions. The cladding material or aluminum thus has a substantial thickness. Since the melting point of aluminum is greatly different from that of the body-forming ordinary steel, it is impossible to spot weld alumimum to ordinary steel. This invites a substantial reduction in productivity of automobile manufacture.

The worsening corrosive environment mentioned above also imposes a problem on welded pipe-making material. The corrosion resistance of the above-mentioned aluminized steel is insufficient and the outside of a pipe at a weld joint is substantially corroded to such an extent that a pore might be formed across the pipe wall. The recent trend in the manufacture of exhaust gas conduits is to replace the aluminized steel by 11–13% Cr stainless steels having higher corrosion resistance than aluminized steel such SUH 409 and SUS 410. Although they are stainless steels, they are not satisfactorily corrosion resistant under the worsening corrosive environment because of their low chromium content (Cr 11–13%), and suffer from substantial corrosion particularly at weld joints.

As previously described, it is known to increase the content of chromium or further add molybdenum to stainless steel to improve the corrosion resistance thereof. A further increase of chromium content or addition of molybdenum to the above-mentioned stainless steel is undesirable as the welded pipe-making material because not only the cost is increased, but the workability of the material itself or the workability of the pipe at a weld joint is lowered. The welded pipe-making material is required to have weldability and workability in itself because it is shaped into a pipe by roll forming the material into a round shape and welding the mating edges by TIG or high frequency welding. Even after the material is shaped into a pipe, the pipe is further worked into a suitable shape. Thus the material must be so workable that no crack may occur in the material itself and at welded joints during subsequent working of the pipe.

SUMMARY OF THE INVENTION

An object of the present invention is to provide a stainless steel sheet useful as an exterior member having improved weatherability and workability.

Another object of the present invention is to provide an inexpensive stainless steel sheet particularly useful as an automobile exterior member which does not induce cosmetic corrosion in the automobile body when the exterior member is joined thereto and which can be spot welded to the body.

A further object of the present invention is to provide a process for preparing such a stainless steel sheet.

A still further object of the present invention is to provide a stainless steel sheet useful in preparing a welded pipe, which has improved corrosion resistance and workability in itself as well as improved corrosion resistance and workability t a weld joint.

We have discovered that when a stainless steel substrate, preferably having a Vickers hardness of up to 220 has on one surface thereof at least one coating layer of at least one member selected from the group consisting of aluminum, an aluminum alloy, zinc and a zinc alloy to a total thickness of as thin as 0.1 to 70 μm, preferably 1 to 70 μm, the resulting stainless steel sheet is imparted with markedly improved weatherability and workability on its uncoated surface so that it is satisfactorily applicable as an exterior member. The coated sheet can be spot welded to a body as an automobile exterior member and occurrence of cosmetic corrosion in the body is prevented.

Making a series of stainless steel sheets comprising a stainless steel substrate having on its one surface a coating layer of a metal electrochemically less noble than the stainless steel to examine their corrosion resistance, weldability and workability at weld joints, we have further discovered that a stainless steel sheet comprising a stainless steel substrate having a coating layer formed on its one surface from at least one member selected from Zn and Zn alloys such as Zn-Ni, Zn-Fe, and Zn-Mn alloys rather than Al, Al alloys, and Mg alloys, and having a total thickness of 0.1 to 50 μm, preferably 1 to 50 μm, exhibits improved corrosion resistance and workability, exhibits good workability and improved corrosion resistance at a weld joint after it is formed into a welded pipe, fulfills the requirements for weld couplings and weld pipes, and is thus fully applicable as weld pipes required of corrosion resistance, including automobile exhaust gas conduits.

It is known in the prior art that when a stainless steel sheet is covered with a layer of a metal which is electrochemically less noble than the stainless steel, the covered surface of the sheet is prevented from corrosion due to sacrificial dissolution of the less noble metal layer. See Japanese Patent Application Kokai No. 57-26187. However, we have first discovered that by applying a metal coating layer as thin as 1.0 to 70 μm to a stainless steel sheet, improved weatherability is imparted to the uncoated surface of the sheet of sufficient dimensions to be used as automobile moldings or exterior building members or a welded pipe prepared from such coated steel, for example, an automobile exhaust gas conduit, particularly at its weld joint.

According to a first aspect of the present invention, there is provided an exterior stainless steel sheet comprising a stainless steel substrate, preferably having a Vickers hardness of up to 220, and at least one coating layer formed on one surface of the steel substrate from at least one member selected from the group consisting of aluminum, aluminum alloys, zinc and zinc alloys to a thickness of 0.1 to 70 μm, preferably 1 to 70 μm.

Preferably, the outermost coating layer is of zinc or zinc alloy. The outermost coating layer of zinc or zinc alloy may be subjected to a chromate treatment to improve the white rust resistance of the zinc or zinc alloy layer.

In the practice of the present invention, the stainless steel sheet or substrate is preferably a bright annealed stainless steel sheet.

By coating one surface of a stainless steel sheet with Al, Al alloys, Zn or Zn alloys, not only the weatherability of the uncoated surface of the sheet is improved, but also the cosmetic corrosion resistance of the body is improved when the sheet is attached to a body as an automobile exterior member. Nevertheless, the adherence between stainless steel sheet and the coating layer is generally low, and particularly, Zn or Zn-Ni alloy electroplated stainless steel sheet suffers from poor plating adherence. Thus the plating is liable to separate or spall when severe forming or shaping is required on exterior members for building and automobile applications. This results in serious problems that coated stainless steel sheets lose their weatherability and the cosmetic corrosion resistance of the body is markedly reduced in the case of automobile exterior members.

Most of automobile exterior members are bright annealed stainless steel sheets. When such bright annealed stainless steel sheets are electroplated with zinc or zinc-nickel alloy, there remains a problem that the plating has poor adherence.

Stainless steel sheets used as building or automobile exterior members are generally cut from cold rolled steel strips. It, of course, promises an economic benefit if one-side plated stainless steel strip having improved plating adherence can be produced. Making investigations to improve the plating adherence of Zn or Zn-Ni alloy electroplated stainless steel sheets, we have discovered that when the surface to be plated is subject to a suitable activating treatment and plating is carried out in a plating bath at a pH level lower than a predetermined value, that is, under predetermined acidic conditions, there is deposited a Zn or Zn-Ni alloy coating having improved adherence.

According to a second aspect of the present invention, there is provided a process for preparing a Zn or Zn-Ni alloy plated stainless steel strip, comprising the steps of:

degreasing a stainless steel strip, subjecting the surface of the strip to substantial activation, and electroplating the strip in a zinc or zinc-nickel alloy plating bath at pH 3.5 or lower.

In further experiments, a cold rolled stainless steel strip was continuously processed in an electroplating line with parameters set to the above-defined ranges. It has been found that although plating adherence is markedly improved, the exterior surface or uncoated surface of the steel strip often undergoes mars and scratches which are critical defects as exterior members. The strip must subsequently be polished to remove such defects, requiring an additional expense.

The electroplating procedure generally involves a pretreatment of removing an oxide coating deposited on the strip surface to be plated using hydrochloric acid or sulfuric acid solution. The strip surface not to be plated can be attacked by such chemicals to form a discolored surface layer, creating a serious problem for exterior stainless steel strips.

During one-side electroplating of a stainless steel strip, scratches and luster loss due to discolorationare often introduced on the strip surface not to be plated which serves as an exterior surface. Such scratches and luster loss are critical defects as exterior members. We have found that scratches are introduced as a result of slippage between the strip and rolls in the plating line, particularly the conductor roll.

We have also found that luster loss due to discoloration occurs because the pretreatment for removing oxide coating on the surface prior to electroplating generally accompanies chemical reaction which causes discoloration of the non-plating surface.

These problems can be overcome by applying a protective film to the non-plating surface and arranging rolls such that the conductor roll contacts only the plating surface.

According to a third aspect of the present invention, there is provided a process for preparing a one-side electroplated exterior stainless steel strip, comprising electroplating one side of a stainless steel strip with zinc or zinc alloy while covering another side of the strip not to be plated with a protective film.

The present invention also provides a stainless steel sheet from which a welded pipe is prepared, comprising a stainless steel substrate, and at least one coating layer formed on one surface of the steel substrate from at least one member selected from the group consisting of zinc and zinc alloys to a thickness of 0.1 to 50 μm, preferably 1 to 50 μm.

Preferably, the zinc alloys are Zn-Ni alloys, Zn-Fe alloys, and Zn-Mn alloys.

BRIEF DESCRIPTION OF THE DRAWINGS

The above and other objects, features, and advantages of the present invention will be fully understood by reading the following description taken in conjunction with the accompanying drawings, in which.

DETAILED DESCRIPTION OF THE INVENTION

Figure 1:
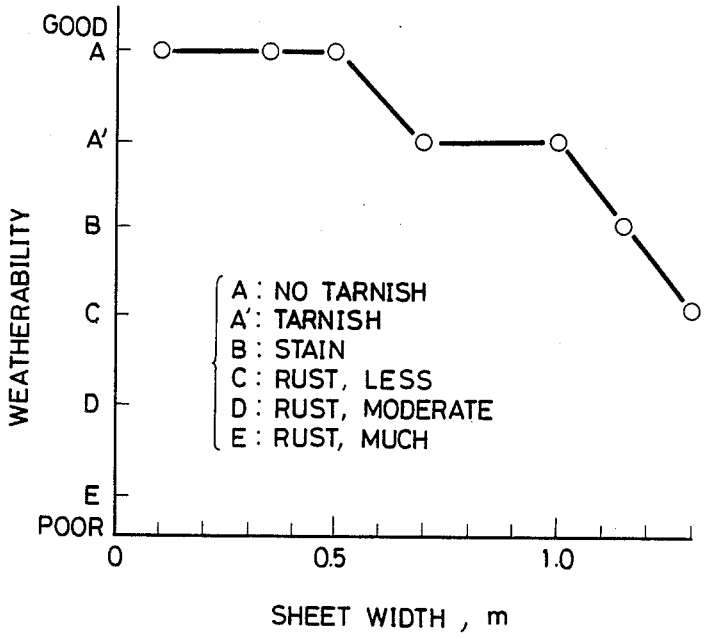
FIG. 1 is a diagram showing the weatherability of the uncoated surface of stainless steel sheets having a Zn layer coated thereon as a function of sheet width.

The exterior stainless steel sheet according to the present invention comprises a stainless steel substrate having adhered thereto a coating layer of a metal which is less noble than the stainless steel. The metal coating layer is subject to sacrificial dissolution whereas the stainless steel is given sacrificial corrosion prevention:

This is predicated on the following findings. In a first weathering test, samples having a thin metal coating layer deposited on one surface of stainless steel were exposed to weather for one year. The uncoated surface of the sample having a metal coating layer less noble than stainless steel exhibited marked weatherability. In a second weathering test, a sample having a thin metal coating layer deposited on one surface of stainless steel was joined to an automobile lacquered steel sheet having one surface cross cut with a knife such that the coated surface of the former contacted the cross-cut surface of the latter. The assembly was subjected to a weathering test at the seashore for one year to examine the cosmetic corrosion resistance of the automobile lacquered steel sheet. A sample having a metal coating layer less noble than stainless steel generated no blister along cross-cuts on the cross-cut surface, indicating that the automobile lacquered steel sheet had a markedly improved cosmetic corrosion resistance and the stainless steel had a markedly improved corrosion resistance on its uncoated surface. A sample having no such metal coating layer generated much blisters along cross-cuts on the automobile lacquered steel sheet and the uncoated surface or decorative exterior surface of the stainless steel generated rust and was thus less resistant to corrosion.

The metal coating layer adhered to a stainless steel sheet is of at least one member selected from the group consisting of metal materials electrochemically less noble than the stainless steel, specifically, aluminum (Al), an aluminum alloy, zinc (Zn), and a zinc alloy in the case of exterior stainless steel sheets.

Examining the color and quantity of rust dissolving out due to sacrificial dissolution of a metal layer coated to stainless steel, we have found that when Al, Al alloys, Zn or Zn alloys is coated, the rust is dissolved out in a relatively small quantity and in white color so that the appearance of the automobile exterior member is not impaired.

Various types of Al and Zn alloys are known. Generally, the type of Al and Zn alloys is not particularly limited as long as they are Al or Zn base alloys exhibiting their fundamental properties. With respect to the quantity of white rust dissolved out, Zn coated surface is inferior to Al or Al alloy coated surface. However, a significant improvement is achieved by replacing zinc coating by zinc alloy coating, for example, Zn/9–14% Ni alloy coating. One side zinc alloy coating is desirable rather than zinc coating particularly under a severe corrosive environment. To further control the quantity of white rust generated with zinc and zinc alloy coatings, we have found that a chromate treatment on these coatings is effective. A chromate treatment to a depth of less than 0.001 μm is little effective in controlling the quantity of white rust. A chromate coating of thicker than 1 μm will reduce spot weldability. The chromate coating preferably has a thickness of 0.001 to 1.0 μm.

The chromate treatment includes three known types, electrolytic, reactive, and coating treatments. Since these types of treatment give substantially equal results, the type of chromate treatment is not particularly limited.

When more than one metal coating layer of Al, Al alloys, Zn or Zn alloys are formed one on the other, there is no detrimental effect on the improvements in weatherability of the uncoated surface of stainless steel sheet and cosmetic corrosion resistance of automobile lacquered steel sheet. It is thus within the scope of the present invention to place more than one metal coating in laminate form. The total thickness of a metal coating layer or a laminate of metal coating layers ranges from 0.1 to 70 μm, preferably 1 to 70 μm.

A metal coating layer of less than 0.1 μm in thickness is undesirable because stains develop on the uncoated surface of stainless steel to impair its aesthetic appearance in a weathering test as mentioned previously, and because the ability of automobile lacquered steel sheet to maintain its cosmetic corrosion resistance is lost. In addition, when the thickness of a metal coating layer is 1 μm or more, stains hardly develop on the uncoated surface and the ability of the cosmetic corrosion resistance is enough. On the other hand, a metal coating layer of more than 70 μm in thickness is undesirable because irrespective of the method of coating, the coating layer can be separated during press forming as experienced with the conventional cold rolled aluminum clad stainless steel, and because spot weldability is considerably reduced. When more than one metal coating layer of Al, Al alloys, Zn or Zn alloys is formed in laminate form and the outermost layer is Zn or Zn alloy, the quantity of white rust generated on the coated surface can be minimized by applying a chromate treatment on the outermost Zn or Zn alloy layer as described above.

The type of stainless steel on which a metal coating layer is formed is not particularly limited because by coating any of martensitic, ferritic and austenitic stainless steels with a thin metal layer as defined above, the uncoated surface of steel can be improved in weatherability. Stainless steel sheets used as automobile exterior members are preferably of ferritic and austenitic stainless steel having a Cr content of 15 to 24% because they are exposed to a severer corrosive environment caused by dispersing rock salt on the road surface for freeze prevention as compared with usual exterior members. Stainless steel containing less than 15% of Cr tends to allow stains to develop on the uncoated surface. Chromium contents of more than 24% provide no further improvement and only add to the cost.

The stainless steel preferably has a Vickers hardness of up to 220. Steel having a Vickers hardness of more than 220 is undesirable because of low press formability or workability.

Next, the surface finish of stainless steel will be described in connection with weatherability.

The surface finish of cold rolled stainless steel sheet is generally classified into as-pickled (2D), pickling followed by skin pass (2B), hair line finish, and bright annealed (BA).

For the exterior stainless steel sheet of the present invention, a bright anneal finished stainless steel with its uncoated surface serving as an exterior surface exhibits significantly improved weatherability on the surface as compared with other surface-finished stainless steels. The weatherability of one-side coated bright annealed stainless steel is significantly improved over the conventional cold rolled aluminum clad stainless steel. Thus the use of bright annealed stainless steel provides an aesthetic surface and improved weatherability, and the expense for manufacture is reduced because the buffing step of cold rolled clad material can be eliminated.

The metal coating layer may be applied to a stainless steel sheet by any desired techniques including electroplating, hot dipping, vacuum deposition, and spraying. The presence of working strain induced in stainless steel is undesirable because the press workability of stainless steel is lowered. Thus it is desired to choose an application technique which leaves minimized working strain. Among a variety of known coating techniques, electroplating, hot dipping, vacuum deposition, and spraying techniques are suitable. These techniques introduce little strain into sheet stainless steel upon coating so that press workability is little affected, and are very easy to apply a metal layer as thin as 0.1 to 70 μm.

When aluminum, aluminum alloy, zinc or zinc alloy is coated to stainless steel, a pretreatment (for example, plating of another metal such as nickel, and chemical conversion) may be carried out on the stainless steel surface to enhance the bond with a subsequently applied thin metal layer. Such a pretreatment does not adversely affect the present invention and is thus contemplated as falling within the scope of the present invention.

For stainless steel sheets having formed on one surface a metal coating layer of at least one of Al, Al alloys, Zn and Zn alloys, the weatherability of the uncoated surface or exposed stainless steel surface and the transverse width of stainless steel sheets are related as shown in FIG. 1. More particularly, a weathering test used bright anneal finished SUS 434 stainless steel sheets (thickness 0.5 mm, length 1 m, width 0.1–1.3 m) having a 10 μm Zn layer electroplated on one surface. The samples were exposed to weather at the seashore for one year, Oihama seashore, Chiba, Japan. FIG. 1 illustrates the results of weatherability of the samples.

As evident from FIG. 1, sheets as large as about 1 m×1 m can maintain characteristics of weatherability, but as the width becomes narrow, the coating layer exerts more sacrificial corrosion preventing effect, resulting in more improved weatherability. Stainless steel sheets having a metal coating layer on one surface are thus particularly suitable as narrow or elongate members like automobile exterior members.

Examples of the present invention are given below by way of illustration and not by way of limitation.

EXAMPLES 1–12

There were used buff polished sheets and bright annealed (BA) sheets of SUS 434, SUS 304 and 19 Cr-0.5 Cu-0.4 Nb-0.02 C-0.01 N stainless steel having a thickness of 0.5 mm. The stainless steel sheets on one surface were coated with a variety of metal layers by known techniques of electroplating, hot dipping, vacuum deposition, and plasma spraying (using Ar gas) as shown in Table 1.

A weathering test was carried out by exposing the uncoated surface (150 mm×250 mm) of the stainless steel sheets for one year at the seashore, Oihama seashore, Chiba, Japan. Press working tests were carried out, including an Erichsen test and the measurement of limited drawing ratio.

The test results are shown in Table 1.

The methods for testing and evaluating weatherability and workability are as described below.

(1) Weatherability

Visual observation after one year exposure to weather at Oihama seashore, Chiba, Japan.

A: No tarnish
A': Tarnish
B: Stain
C: Rust, less
D: Rust, moderate
E: Rust, much (2) Workability (2-1) Erichsen Cup drawing test according to JIS Z 2247.

(2-2) Limited drawing ratio (LDR)

A sample sheet was drawn by forcing a punch having a diameter of 33 mm using graphite grease as lubricant.

The samples within the scope of the present invention showed neither stain nor rust independent of the coating method of stainless steel, indicating good weatherability.

When BA steel was coated with a thin metal layer, the uncoated surface exhibited no tarnish and maintained the same appearance as before the test.

No degradation of workability was observed.

COMPARATIVE EXAMPLES 1-4

Comparative samples were prepared by coating stainless steel sheets as used in Examples 1-12 with a metal coating layer having a thickness less than the range of the present invention or without forming a metal coating layer. The samples were tested for weatherability and workability as in Examples 1-12.

The results are also shown in Table 1.

In comparative samples free of a Zn, Zn alloy, Al or Al alloy layer, a noticeable amount of stain and rust occurred on the stainless steel surface.

COMPARATIVE EXAMPLE 5

A comparative sample was prepared by cladding a 0.20 mm thick sheet of SUS 434 and a 0.40 mm thick sheet of Al-Mg alloy (A 5052) through cold rolling into a clad sheet of 0.5 mm thick, followed by heating the clad sheet at 450° C. for recrystallization of Al-Mg alloy, and buffing the stainless steel surface. The clad sheet was tested for weatherability and workability as in Examples 1-12.

The results are also shown in Table 1.

Although the clad sheet has good weatherability, it is very low in workability and thus cannot be press formed into a complicated shape.

TABLE 1

| Sample No. | Stainless steel | Coating method | Coating metal | Coating thickness (μm) | Weathering test 1 year BA surface | Weathering test 1 year buffed surface | Stainless steel Vickers hardness | Workability Erichsen (mm) | Workability LDR |
|---|---|---|---|---|---|---|---|---|---|
| example 1 | SUS 434 | electro-plating | Zn | 10 | A | A' | 160 | 9.1 | 2.05 |
| example 2 | SUS 434 | electro-plating | Zn-13% Ni | 8 | A | A' | 160 | 9.1 | 2.0 |
| example 3 | SUS 434 | electro-plating | Zn* + Zn-13% Ni** | 10 + 15 | A | A' | 160 | 9.0 | 2.05 |
| comparative example 1 | SUS 434 | electro-plating | Zn | <0.1 | B | B | 160 | 9.0 | 2.0 |
| example 4 | SUS 434 | hot dipping | Al | 15 | A | A' | 160 | 8.9 | 2.0 |
| example 5 | SUS 434 | hot dipping | Zn-55% Al-1.5% Si | 10 | A | A' | 160 | 9.0 | 2.0 |
| example 6 | SUS 434 | hot dipping | Al* + Zn** | 20 + 25 | A | A' | 160 | 9.1 | 2.05 |
| example 7 | SUS 434 | vacuum deposition | Al | 2 | A | A' | 160 | 9.1 | 2.0 |
| example 8 | SUS 434 | plasma spray | Zn | 30 | A | A' | 160 | 9.1 | 2.0 |
| comparative example 2 | SUS 434 | no coating | — | — | D | D | 160 | 9.0 | 2.0 |
| example 9 | 19Cr—0.5Cu—0.4Nb | electro-plating | Zn | 13 | A | A' | 165 | 9.4 | 2.1 |
| example 10 | 19Cr—0.5Cu—0.4Nb | electro-plating | Zn-13% Ni | 12 | A | A' | 165 | 9.5 | 2.1 |
| example 11 | 19Cr—0.5Cu—0.4Nb | hot dipping | Al | 30 | A | A' | 165 | 9.4 | 2.1 |
| comparative example 3 | 19Cr—0.5Cu—0.4Nb | no coating | — | — | C | C | 165 | 9.5 | 2.1 |
| example 12 | SUS 304 | electro-plating | Zn | 11 | A | A' | 170 | 12 | 2.05 |
| comparative example 4 | SUS 304 | no coating | — | — | C | C' | 170 | 12 | 2.05 |
| comparative example 5 | Clad sheet | — | — | — | — | A' | 250 | 4 | 1.3 |

*lower layer
**upper layer

EXAMPLES 13-24

Samples used were bright annealed (BA) stainless steel sheets having a metal layer coated on one surface thereof as in Examples 1-12. The samples were tested for weatherability, and welded to automobile lacquered steel sheets to examine the cosmetic corrosion resistance of the latter and spot weldability.

Tests for examining weatherability and cosmetic corrosion resistance are carried out as follows.

An automobile lacquered steel sheet in the form of a cold rolled steel sheet SPCE of 1.0×200×300 mm was cross cut with a knife. A coated stainless steel sheet sample was welded to the lacquered steel sheet by spot welding such that the metal coated surface of the former of 150×250 mm faced the cross-cut surface of the latter. The assembly was placed at an angle of 45° and subjected to cyclic corrosion test 5 times, each consisting of spraying 3.5% salt water for 10 minutes, drying at 60° C. for 155 minutes, wetting at a relative humidity of 95%, 50° C. for 75 minutes, drying at 60° C. for 80 minutes, and weting at a relative humidity of 95%, 50° C. for 160 minutes. This was one cycle of corrosion test. The corrosion test was carried out 100 cycles. After the corrosion test, the uncoated surface of the samples was visually observed to evaluate weatherability. The maximum average width of blisters generated on the cross-cut surface of the automobile lacquered steel sheets was measured to evaluate cosmetic corrosion resistance. The visual observation on the uncoated surface was rated as in Examples 1-12.

Spot weldability was evaluated by facing the coated surface of a sample against a stainless or ordinary steel sheets, spot welding the sample and sheet using a copper tip of 8 mm in diameter under vaying pressure and welding current applied, and determining the bond strength of the welds. Evaluation was made by rating weldability into three grades, good, moderate, and poor.

The results are shown in Table 2.

Regardless of the method of application of a metal coating to stainless steel sheet, the samples of the present invention generated no stain or rust on the uncoated stainless steel surface, indicating excellent weatherability. Little blister occurred at the crosscuts on the automobile lacquered steel sheet, indicating excellent cosmetic corrosion resistance. Further spot weldability was excellent.

COMPARATIVE EXAMPLES 6-9

Comparative samples were prepared by coating stainless steel sheets as used in Examples 1-12 with a metal coating layer having a thickness below the range of the present invention or without forming a metal coating layer. The samples were tested for weatherability, cosmetic corrosion resistance, and spot weldability as in Examples 13–24.

The results are also shown in Table 2.

COMPARATIVE EXAMPLE 10

A clad sheet as used in Comparative Example 5 was tested for weatherability, cosmetic corrosion resistance, and spot weldability as in Examples 13–24.

The results are also shown in Table 2.

In the comparative sample free of a Zn, Zn alloy, Al or Al alloy layer, much blisters generated at crosscuts on the automobile lacquered steel sheet, indicating very poor cosmetic corrosion resistance.

The clad sheet provided good cosmetic corrosion resistance, but exhibited very poor spot weldability.

TABLE 2

| Sample No. | Stainless steel | Coating method | Coating metal | Coating thickness (μm) | Weatherability of uncoated surface | CCR (blister width mm) | Spot weldability |
|---|---|---|---|---|---|---|---|
| example 13 | SUS 434 | electro-plating | Zn | 10 | A | 1 | Good |
| example 14 | SUS 434 | electro-plating | Zn-13% Ni | 8 | A | 1 | Good |
| example 15 | SUS 434 | electro-plating | Zn* + Zn-13% Ni** | 10 + 15 | A | 1.5 | Good |
| comparative example 6 | SUS 434 | electro-plating | Zn | <0.1 | B | 5 | Good |
| example 16 | SUS 434 | hot dipping | Al | 15 | A | 1 | Good |
| example 17 | SUS 434 | hot dipping | Zn-55% Al-1.5% Si | 10 | A | 1 | Good |
| example 18 | SUS 434 | hot dipping | Al* + Zn** | 20 + 25 | A | 1 | Good |
| example 19 | SUS 434 | vacuum deposition | Al | 2 | A | 1 | Good |
| example 20 | SUS 434 | plasma spray | Zn | 30 | A | 1 | Good |
| comparative example 7 | SUS 434 | no coating | — | — | D | 12 | Good |
| example 21 | 19Cr-0.5Cu-0.4Nb | electro-plating | Zn | 13 | A | 1 | Good |
| example 22 | 19Cr-0.5Cu-0.4Nb | electro-plating | Zn-13% Ni | 12 | A | 1.5 | Good |
| example 23 | 19Cr-0.5Cu-0.4Nb | hot dipping | Al | 30 | A | 1 | Good |
| comparative example 8 | 19Cr-0.5Cu-0.4Nb | no coating | — | — | C | 11 | Good |
| example 24 | SUS 304 | electro-plating | Zn | 11 | A | 1 | Good |
| comparative example 9 | SUS 304 | no coating | — | — | C | 13 | Good |
| comparative example 10 | Clad sheet | — | — | — | A' | 1 | Poor |

*lower layer
**upper layer

EXAMPLES 25–27

The Zn and Zn-13% Ni one-side electroplated SUS 434 stainless steel sheets (in BA form) of Examples 13 and 14 shown in Table 2 were subjected to a chromate treatment as shown in Table 3. The chromated samples, together with untreated sample and the Al hot-dipped sample of Example 16, were examined for white rust formation by a CASS test (copper accelerated acetic acid salt spray test according to JIS D 0201, one cycle 16 hours spraying) as well as weatherability of the uncoated surface, cosmetic corrosion resistance, and spot weldability by the same tests as described above. The results are shown in Table 4.

The chromate treated, Zn and Zn-13% Ni coated stainless steel sheets are remarkably prevented from white rust formation as compared with the untreated, Zn and Zn-13% Ni coated stainless steel sheets and exhibit more resistance to white rust as compared with Al coated stainless steel sheet.

However, when the chromate coating exceeds 1 μm in thickness, the weatherability of the uncoated surface and cosmetic corrosion resistance are somewhat reduced. Spot weldability is also adversely affected. For this reason, it is preferred that the chromate coating has a thickness of up to 1.0 μm.

TABLE 3

| Electrolytic Chromate Treatment | |
|---|---|
| Chromate solution composition | |
| Chromic anhydride $CrO_3$ | 30 g/l |
| Sodium silicofluoride $Na_2SiF_6$ | 1 g/l |
| Colloidal silica | 10 ml/l |
| Electrolytic conditions | |
| 50° C. | |
| 10 A/dm$^2$ | |
| Sample: cathode (−) | |

TABLE 4

| Sample No. | Coating metal | Coating thickness (μm) | Chromate coating, thickness (μm) | CASS test, white rust[1] | Weatherability of uncoated surface[2] | Weathering test[3] 1 year | Spot weldability[3] |
|---|---|---|---|---|---|---|---|
| example 25 (13) | Zn | 10 | no | D | A | A | Good |
| | | | 0.10 | B | A | A | Good |
| | | | 1.2 | A | C | C | Poor |
| example 26 (14) | Zn-13% Ni | 8 | no | C | A | A | Good |
| | | | 0.11 | A | A | A | Good |
| | | | 1.3 | A | C | C | Poor |
| example 27 (16) | Al | 15 | no | C | A | A | Good |

[1]*CASS Test (JISD 0201) 16 hour spraying
A: no white rust B: some white rust C: moderate white rust D: noticeable white rust E: much white rust
[2]**Test and evaluation are as in Table 2
[3]***Test and evaluation are as in Table 1
[4]****Test and evaluation are as in Table 2

Where one side of a stainless steel sheet is coated with Al, Al alloy, Zn or Zn alloy, the weatherability of the uncoated surface of stainless steel and the cosmetic corrosion resistance of the body to which the coated stainless steel sheet is welded as an exterior member are markedly improved. However, the adherence between the stainless steel sheet and the coating layer is relatively low so that the coating layer tends to separate off during working of the sheet into a part shape. This is particularly a problem when Zn and Zn-Ni alloy are electroplated.

The present invention provides an improved process for preparing a stainless steel strip having a Zn or Zn-Ni alloy coating electroplated thereon with the adherence of the coating to the strip being improved.

According to the second aspect of the present invention, there is provided a process for preparing a Zn or Zn-Ni alloy plated stainless steel strip, comprising the steps of: degreasing a stainless steel strip; substantially activating the surface of the strip; and electroplating the strip in a zinc or zinc-nickel alloy plating bath at pH 3.5 or lower.

The degreasing step is essential for the process of the present invention. If the stainless steel strip surface is not degreased prior to activation, grease and other contaminants would cause uneven plating or poor plating adherence when the strip is activated and then electroplated. The parameters for the degreasing step are not particularly limited because it suffices that grease and other contaminants are substantially removed. Preferred degreasing is electrolytic degreasing in an aqueous alkaline solution of NaOH or similar alkalis containing a surface-active agent.

Then a substantial activation treatment is carried out on the stainless steel strip surface. By the term substantial activation it is meant that the stainless steel strip surface is treated such that the adherence of a plating thereto is improved during a subseqent plating step. The activation treatment may be any suitable one of chemical treatments such as alkali and acid treatments, electrolytic treatments, and physical treatments such as sand blasting. Preferably, the following activation treatments are employed.

The activation treatment is important in that unless the stainless steel strip surface is substantially activated, plating adherence is not improved even by optimizing the degreasing and plating steps taken before and after the activation treatment.

(1) Immersion in aqueous hydrochloric acid of 0.5 to 40% by weight at 25° to 90° C.

At hydrochloric acid concentrations of less than 0.5%, immersion of stainless steel at higher temperatures or for an extended period of more than 3 minutes fails to accomplish substantial activation. Then a Zn or Zn-Ni alloy plating is less adherent to the steel even when plating is carried out under optimum conditions as will be mentioned later. Higher hydrochloric acid concentrations are advantageous for activation of stainless steel, but concentrations of more than 40% hydrochloric acid give no further favorable influence on the activation of stainless steel, but an economic disadvantage. In addition, hydrogen chloride vapor would damage the plating installation.

Even when the hydrochloric acid concentration is within the optimum range, temperatures of lower than 25° C. will extremely prolong the time required for activation. Higher solution temperatures are advantageous for activation of stainless steel, but temperatures in excess of 90° C. generate a greater volume of hydrogen chloride vapor, severely damaging the plating installation. Thus the temperature of aqueous hydrochloric acid used in immersion ranges preferably from 25° to 90° C.

It takes at least 2 seconds to achieve activation by immersing stainless steel in aqueous hydrochloric acid of the optimum concentration and temperature ranges mentioned above. That is, at least 2 seconds of the immersion time is needed. In view of productivity of a process of plating a stainless steel strip with Zn or Zn alloy, the activation time is preferably at most 3 minutes.

(2) Immersion in sulfuric acid of 1 to 100% by weight at 50° to 90° C.

At sulfuric acid concentrations of less than 1%, immersion of stainless steel at higher temperatures or for an extended period of more than 3 minutes fails to accompolish substantial activation. Then plating adherence is poor even under optimum plating conditions. Higher sulfuric acid concentrations are advantageous for activation of stainless steel, and the concentration of 100% does not damage the plating installation by hydrogen sulfate vapor.

Even when the sulfuric acid concentration is within the optimum range, temperatures of lower than 50° C. will extremely prolong the time required for activation. Higher solution temperatures are advantageous for activation of stainless steel, but temperatures in excess of 90° C. generate a greater volume of hydrogen sulfate vapor, severely damaging the plating installation.

The immersion time is at least 2 seconds with sulfuric acid of the optimum concentration and temperature ranges.

(3) Cathodic electrolysis in aqueous hydrochloric acid of 0.5 to 40 wt % at a temperature of up to 90° C. and a current density of 0.1 to 100 A/dm$^2$ An activation treatment in aqueous hydrochloric acid requires electrolysis at a concentration of at least 0.5% and a current density of at least 0.1 A/dm$^2$ (ampere per square decimeter) for at least 1 second. Hydrochloric acid concentrations of less than 0.5% results in unstable activation even when the current density is increased or the electrolytic time is lengthened, failing to improve plating adherence during subsequent plating even under optimum conditions.

Although higher hydrochloric acid concentrations does not adversely affect the activation of stainless steel, hydrochloric acid concentrations in excess of 40% generate a volume of hydrogen chloride vapor to damage the plating installation.

(4) Cathodic electrolysis in sulfuric acid of at least 1 wt % at a temperature of up to 90° C. and a current density of 0.1 to 100 A/dm$^2$ The activation in aqueous sulfuric acid is electrolysis at a sulfuric acid concentration of at least 1% and a current density of at least 0.1 A/dm$^2$ for at least 1 second for substantially the same reasons as discussed in conjunction with aqueous hydrochloric acid. In case of sulfuric acid, a concentration increase to 100% does not disturb activation or cause damage to the plating installation, and the upper limit is not imposed.

However, if the current density exceeds 100 A/dm$^2$ in either aqueous hydrochloric or sulfuric acid, stainless steel strips are liable to hydrogen embrittlement and blisters generate to impair the appearance. The upper limit of 100 A/dm$^2$ is thus imposed on the current density.

The cathodic electrolysis treatment with a stainless steel strip made cathode may be carried out at any temperatures ranging from room temperature to 100° C. without a substantial influence on activation of stainless steel. However, the upper limit is preferably set at 90° C. because the plating installation is damaged at temperatures of higher than 90° C.

The activation of stainless steel may be carried out by any of the above-mentioned immersion and cathodic electrolysis. Activation by a combination of such treatments is also contemplated herein.

Thereafter, Zn or Zn-Ni alloy is plated on the activated stainless steel strip.

Plating adherence was examined by degreasing stainless steel strips, activating them in aqueous hydrochloric acid or sulfuric acid under the optimum activating conditions mentioned above, and carrying out Zn or Zn alloy plating in a chloride or sulfate bath at varying pH.

Evaluation of plating adherence is made by blanking a disk sample of 66 mm in diameter out of the plated strip, cup drawing the sample by forcing a punch of 33 mm in diameter into a die of 34.5 mm in diameter by means of a hydraulic press, with the plated surface faced outside, applying an adhesive tape to the plated surface of the drawn sample, and removing the tape. The degree of exfoliation of the plating is rated in four grades. The results are shown in FIG. 2.

Figure 2:
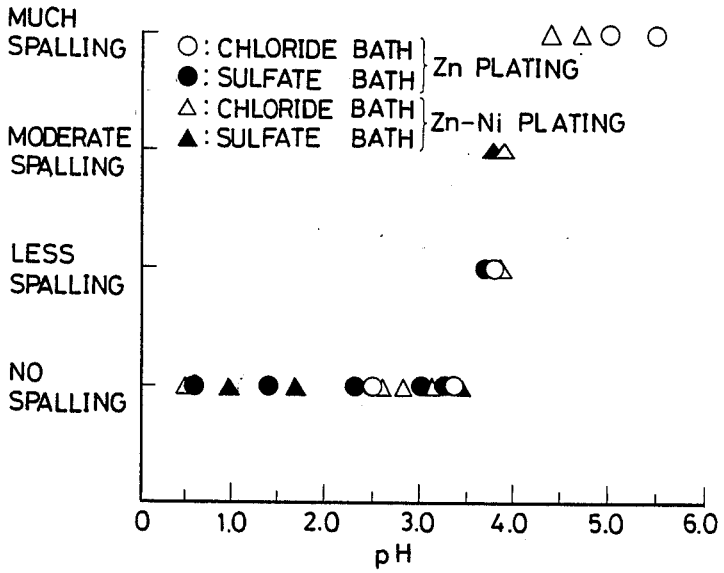
FIG. 2 is a diagram showing the degree of exfoliation of Zn and Zn-Ni platings deposited from chloride and sulfate baths at varying pH levels.

The experimental conditions corresponding to FIG. 2 are given below.

(1) Stainless steel strip

SUS 434 stainless steel of 0.6 mm thick has a composition shown in Table 5.

TABLE 5

| Steel composition in % by weight | | | | | | | | |
|---|---|---|---|---|---|---|---|---|
| C | Si | Mn | P | S | Cr | Ni | Mo | N |
| 0.05 | 0.3 | 0.5 | 0.02 | 0.001 | 16.2 | 0.03 | 0.9 | 0.02 |

(2) Degreasing

Alkaline electrolytic degreasing is carried out, with SUS 434 stainless steel made anode, in an aqueous solution of 2.5% NaOH containing 2 g/l of surface active agent at a current density of 1 A/dm$^2$.

(3) Activation

Immersion in 10% aqueous hydrochloric acid at 50° C. for 40 seconds.

(4) Plating

The plating conditions are shown in Table 6.

TABLE 6

| | | Plating bath | Plating conditions | | pH range |
|---|---|---|---|---|---|
| Zn plating | 20 A/dm$^2$ 10μ one-side plating | chloride bath | $ZnCl_2$ | 210 g/l | Adjusted with HCl to 2.5–5.5 |
| | | | KCl | 360 g/l | |
| | | | Electrode | Zn | |
| | | | Temp. | 60° C. | |
| | | sulfate bath | $ZnSO_4$ $7H_2O$ | 450 g/l | Adjusted with $H_2SO_4$ and NaOH to 0.5–4.0 |
| | | | $Na_2SO_4$ | 20 g/l | |
| | | | $K_2SO_4$ | 20 g/l | |
| | | | Electrode | Pb-13% Sn | |
| | | | Temp. | 58° C. | |
| Zn-13% Ni alloy plating | 20 A/dm$^2$ 10μ one-side plating | chloride bath | $NiCl_2$ $6H_2O$ | 63 g/l | Adjusted with HCl and KOH to 2.5–5.0 |
| | | | $ZnCl_2$ | 286 g/l | |
| | | | KCl | 350 g/l | |
| | | | Electrode | Zn | |
| | | | Temp. | 60° C. | |
| | | sulfate bath | $NiSO_4$ $6H_2O$ | 300 g/l | Adjusted with $H_2SO_4$ and NaOH to 0.5–4.0 |
| | | | $ZnSO_4$ $7H_2O$ | 130 g/l | |
| | | | $Na_2SO_4$ | 20 g/l | |
| | | | $K_2SO_4$ | 20 g/l | |
| | | | Electrode | Pb-13% Sn | |
| | | | Temp. | 55° C. | |

It is evident from FIG. 2 that by adjusting the pH of the plating bath to 3.5 or lower, plating adherence is improved to achieve no plating exfoliation, irrespective of whether the plating is of Zn or Zn-Ni alloy and whether the plating bath is of chloride or sulfate type.

Even when stainless steel has been subjected to the optimum activation treatment mentioned above, plating baths of higher than pH 3.5 deposit less adherent platings. Provided that stainless steel has been subjected to the optimum activation treatment, the factor that determines whether plating adherence is high or low is not the type of plating bath, but simply the pH level thereof.

Based on the above experimental facts, the process of the present invention limits the pH of the plating bath to 3.5 or below. The lower limit is not particularly limited because of no significance.

Examples of the Zn and Zn-Ni alloy electroplating process are given below.

EXAMPLE 28

Bright annealed 0.6 mm thick sheets of SUS 434 and SUS 304 having the chemical compositions shown in Table 7 were cut to dimensions of 250×450 mm, degreased, activated and plated on one surface with Zn and Zn alloy to a plating thickness of 8 μm. The conditions of alkaline electrolytic degreasing and activation treatment are shown in Table 8. Plating was carried out under the conditions shown in Table 9 while varying the pH of the bath, to examine plating adherence.

Evaluation of plating adherence is made by blanking a disk sample of 66 mm in diameter out of the plated piece, cup drawing the sample by forcing a punch of 33 mm in diameter into a die of 34.5 mm in diameter by means of a hydraulic press, with the plated surface faced outside, applying an adhesive tape to the plated surface of the drawn sample, and removing the tape.

The degree of exfoliation of the plating is rated in four grades.

The results are shown in Table 10.

Without alkaline electrolytic degreasing, even when the subsequent activation and plating are effected within the scope of the present invention, the resulting plating becomes uneven and less adherent irrespective of whether the plating is of Zn or Zn-13% Ni alloy or the type of stainless steel.

If the activation treatment after alkaline electrolytic degreasing is effected outside the scope of the present invention or insufficient, the resulting plating of Zn or Zn-13% Ni alloy is less adherent even when it is deposited from a plating bath at pH 3.5 or lower, that is, within the range of the present invention.

When stainless steel is subjected to alkaline electrolytic degreasing and activation treatment within the ranges of the present invention, a plating bath of above pH 3.5 produces a less adherent plating irrespective of the type of steel or plating bath composition, but a plating bath of pH 3.5 or lower produces a fully adherent plating.

EXAMPLE 29

Figure 3:
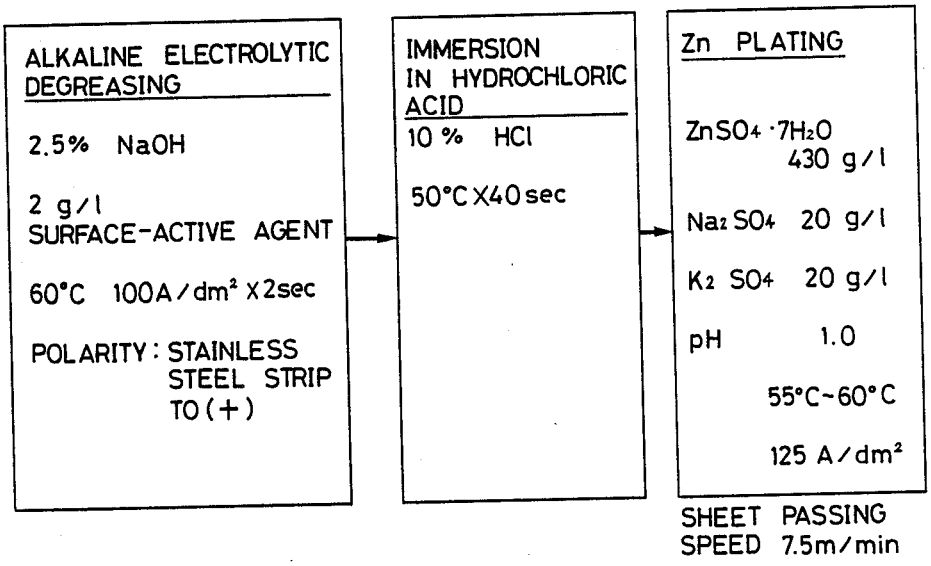
FIG. 3 is a block diagram showing a process of producing a one-side zinc plated stainless steel strip.

There were used bright annealed cold rolled steel strips (0.6 mm thick, 1000 mm wide) of SUS 434 and SUS 304 having the same compositions as shown in Table 7. The strips were passed through a one-side zinc plating laboratory plant under the conditions shown in FIG. 3, producing one-side zinc plated stainless steel strips. The zinc plating had a thickness of 8 μm. The one-side zinc plated stainless steel strips of SUS 434 and SUS 304 exhibited very good adherence of the Zn plating and can be worked into automobile moldings without exfoliation of the plating.

TABLE 7

| | (wt %) | | | | | | | | | | |
|---|---|---|---|---|---|---|---|---|---|---|---|
| Steel | C | Si | Mn | P | S | Cr | Ni | Cu | Mo | N | Al |
| SUS 434 | 0.06 | 0.3 | 0.6 | 0.03 | 0.001 | 16.1 | 0.05 | 0.03 | 0.95 | 0.03 | 0.005 |
| SUS 304 | 0.05 | 0.5 | 1.2 | 0.03 | 0.002 | 18.2 | 8.5 | 0.09 | 0.08 | 0.04 | 0.001 |

TABLE 8

| | Parameters |
|---|---|
| Pretreatment | |
| Alkaline electrolytic degreasing | 2.5% NaOH, 2 g/l surface-active agent, Temp. 60° C. C. D. 100 A/dm$^2$ × 2 sec. Polarity: Stainless steel to (+) |
| Activation treatment | |
| Hydrochloric acid immersion | Immersed in 10% HCl for 20 seconds Temp. 20°, 40°, 60° C. |
| Sulfuric acid cathodic electrolysis | 20% $H_2SO_4$ 5 A/dm$^2$ × 0.5 sec., 10 sec. room temperature |

TABLE 9

| | Plating bath | Plating conditions | | pH range* |
|---|---|---|---|---|
| Zn plating | chloride bath | $ZnCl_2$ | 210 g/l | |
| | | KCl | 360 g/l | |
| | | Temp. | 60° C. | 2.5–5.5 |
| | | C. D. | 30 A/dm$^2$ | |
| | | Electrode | Zn | |
| | sulfate bath | $ZnSO_4.7H_2O$ | 450 g/l | |
| | | $K_2SO_4$ | 40 g/l | |
| | | Temp. | 58° C. | 0.5–4.0 |
| | | C. D. | 30 A/dm$^2$ | |
| | | Electrode | Pb-13% Sn | |
| Zn-13% Ni alloy plating | chloride bath | $NiCl_2.6H_2O$ | 63 g/l | |
| | | $ZnCl_2$ | 286 g/l | |
| | | KCl | 350 g/l | 2.5–5.5 |
| | | Temp. | 60° C. | |
| | | C. D. | 30 A/dm$^2$ | |
| | | Electrode | Zn | |
| | sulfate bath | $NiSO_4.6H_2O$ | 300 g/l | |
| | | $ZnSO_4.7H_2O$ | 130 g/l | |
| | | $Na_2SO_4$ | 20 g/l | 0.5–4.0 |
| | | $K_2SO_4$ | 20 g/l | |
| | | Temp. | 55° C. | |
| | | C. D. | 30 A/dm$^2$ | |
| | | Electrode | Pb-13% Sn | |

*Chloride bath was pH adjusted with HCl and KOH.
Sulfate bath was pH adjusted with $H_2SO_4$ and NaOH.

TABLE 10

| | Alkaline electrolytic degreasing | Activation treatment | Plating bath | pH | Plating adherence SUS 434 | Plating adherence SUS 304 | Remarks |
|---|---|---|---|---|---|---|---|
| Zn plating | No | Immersion in HCl 60° C. × 20 sec | Chloride bath | 3.0 | B | B | Comparison |
| Zn plating | Yes | Immersion in HCl 20° C. × 20 sec | Chloride bath | 2.5 | C | C | Comparison |
| Zn plating | Yes | Immersion in HCl 40° C. × 20 sec | Chloride bath | 3.0 | A | A | Invention |
| Zn plating | Yes | Immersion in HCl 60° C. × 20 sec | Chloride bath | 5.0 | D | D | Comparison |
| Zn plating | Yes | Cathodic electrolysis in $H_2SO_4$ 10 sec | Chloride bath | 3.0 | A | A | Invention |
| Zn plating | Yes | Immersion in HCl 60° C. × 20 sec | Sulfate bath | 4.0 | C | C | Comparison |
| Zn plating | Yes | Immersion in HCl 40° C. × 20 sec | Sulfate bath | 2.0 | A | A | Invention |
| Zn plating | Yes | No | Sulfate bath | 2.0 | D | D | Comparison |
| Zn plating | Yes | Cathodic electrolysis in $H_2SO_4$ 0.5 sec | Sulfate bath | 1.0 | B | B | Comparison |
| Zn plating | Yes | Cathodic electrolysis in $H_2SO_4$ 10 sec | Sulfate bath | 1.0 | A | A | Invention |
| Zn-13% Ni alloy plating | No | Immersion in HCl 60° C. × 20 sec | Chloride bath | 3.0 | B | B | Comparison |
| Zn-13% Ni alloy plating | Yes | Immersion in HCl 20° C. × 20 sec | Chloride bath | 2.5 | C | C | Comparison |
| Zn-13% Ni alloy plating | Yes | Immersion in HCl 40° C. × 20 sec | Chloride bath | 3.0 | A | A | Invention |
| Zn-13% Ni alloy plating | Yes | Immersion in HCl 60° C. × 20 sec | Chloride bath | 5.0 | D | D | Comparison |
| Zn-13% Ni alloy plating | Yes | Cathodic electrolysis in $H_2SO_4$ 10 sec | Chloride bath | 3.0 | A | A | Invention |
| Zn-13% Ni alloy plating | Yes | Immersion in HCl 60° C. × 20 sec | Sulfate bath | 4.0 | C | C | Comparison |
| Zn-13% Ni alloy plating | Yes | Immersion in HCl 40° C. × 20 sec | Sulfate bath | 2.0 | A | A | Invention |
| Zn-13% Ni alloy plating | Yes | No | Sulfate bath | 2.0 | D | D | Comparison |
| Zn-13% Ni alloy plating | Yes | Cathodic electrolysis in $H_2SO_4$ 0.5 sec | Sulfate bath | 1.0 | B | B | Comparison |

TABLE 10-continued

| | Alkaline electrolytic degreasing | Activation treatment | Plating bath | pH | Plating adherence SUS 434 | SUS 304 | Remarks |
|---|---|---|---|---|---|---|---|
| Zn-13% Ni alloy plating | Yes | Cathodic electrolysis in $H_2SO_4$ 10 sec | Sulfate bath | 1.0 | A | A | Invention |

Evaluated in four grades
A: no spalling B: less spalling C: moderate spalling D: much spalling Now we will describe a process for electroplating one surface of a cold rolled stainless steel strip while covering the other or non-plating surface with a protective film in order to prevent scratching of the non-plating surface and luster loss due to discoloration.

The protective films used herein may be films of polyvinyl chloride and polyesters, but not limited thereto. The type, thickness and other parameters of the protective film are not particularly limited as long as it can prevent penetration of treating solutions used in pretreatments and does not chemically react in treating solutions. However, a protective film having a thickness 5 μm or more is desirable because films of less than 5 μm in thickness are liable to breakage, allowing the underlying steel to be scratched or marred.

Application of the protective film to the stainless steel strip may be accomplished by overlying and pressing a protective film to the non-plating surface of the strip or by any other suitable methods. When pretreating solution or plating solution can penetrate between the protective film and the non-plating surface, the protective film may be sealingly bonded to the non-plating surface with adhesive to prevent such penetration.

The protective film applied to the non-plating surface may be removed at any suitable station on the line downstream of the plating station. Alternatively, the strip may be taken up in roll form along with the protective film, and the protective film may be removed on use.

The protective film can be conductive. However, versatile resin films are preferably used for reduction of manufacturing cost. Then, if the conductor roll is brought in contact with the non-plating surface of a stainless steel strip covered with the protective film, the strip cannot be made anode. For this reason, the conductor roll is brought in contact with the plating surface of the strip to enable electricity conduction. Although possible slippage between the conductor roll and the plating surface can introduce scratches, such scratches are concealed by plating and do not affect the appearance because the plating surface is not an exterior surface.

Figure 4:
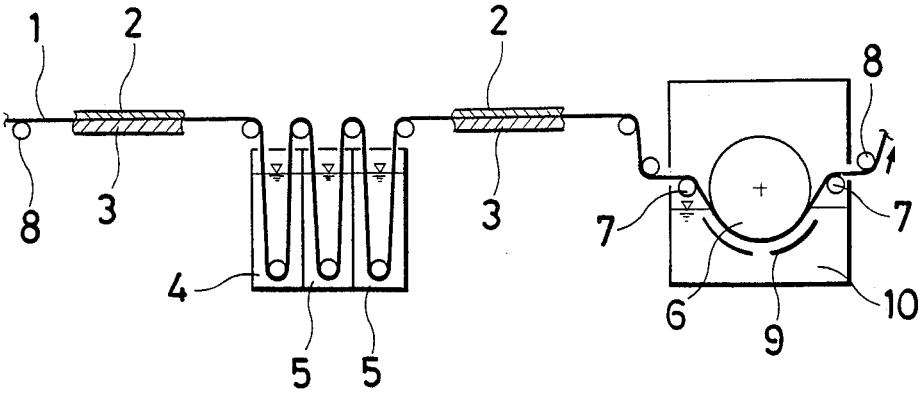
FIG. 4 is a schematic illustration of a laboratory one-side electroplating line according to the present invention.

FIG. 4 schematically illustrates a laboratory scale one-side plating line to which the present process is applied.

A stainless steel strip 1 has one side to be plated 3 and another side not to be plated, the other side being covered with a protective film 2. The one surface 3 of the strip opposite to the protective film covered surface is the side to be plated.

The strip 1 is pretreated by passing it through a pickling bath 4 and a rinsing bath 5.

One side electroplating is then carried out in a plating bath 10. A conductor roll 7 is in contact with the plating surface 3 so that the stainless steel strip 1 becomes an anode. The strip 1 as an anode is guided by a main roll 6 and immersed in the plating bath where the plating surface 3 is faced toward cathodes 9 via the plating solution. Electroplating is thus conducted on the strip 1.

Figure 5:
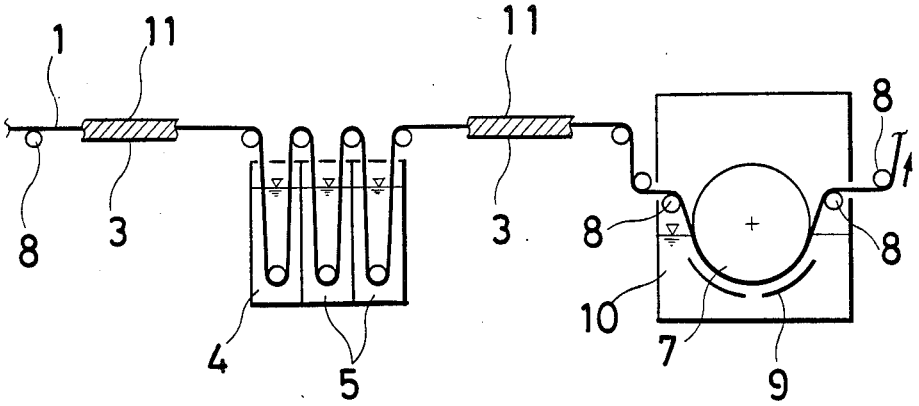
FIG. 5 is a schematic illustration of a laboratory one-side electroplating line according to the prior art.

FIG. 5 schematically illustrates a one-side electroplating line according to a prior art.

Like numerals designate like parts as in FIG. 4. In the prior art, the stainless steel strip 1 is passed without covering it with a protective film. The non-plating strip surface 11 can undergo discoloration or delustering during the pretreatment through the pickling and rinsing baths 4 and 5 and during plating in the plating bath 10.

The non-plating strip surface 11 tends to be scratched due to slipage between the surface and the conductor roll 7 or guide roll 8.

Examples of the present process are given below by way of illustration and not by way of limitation. A comparative example is also given.

EXAMPLE 30 & COMPARATIVE EXAMPLE

A BA stainless steel strip designated SUS 430 of 0.5 mm thick was passed through a laboratory scale zinc electroplating plant as shown in FIG. 4. In the Example, a vinyl chloride film of 0.1 mm thick was applied to one side of the strip 1. The conductor roll 7 was brought in contact with the surface of the strip to be plated with zinc.

In the Comparative Example, a similar stainless steel strip 1 was passed through a laboratory scale zinc electroplating plant as shown in FIG. 5. No protective film was attached to the strip. The main roll serving as a conductor roll 7 was brought in contact with the strip 1 to carry out one side zinc electroplating.

The resulting strips were measured for luster according to JIS Z 8741. Also the strips were visually observed for flaws. The results are shown in Table 11. The strip plated according to the present process using a protective film exhibited no degradation of luster and no flaw. The comparative strip contained much scratches and exhibited a significant degradation of luster.

TABLE 11

| | | Luster | Flaw on non-plated surface |
|---|---|---|---|
| SUS 430 BA | Before plating | 1200 | no |
| Example | plated by present process | 1180 | no |
| Comparative Example | plated by prior art | 500 | much scratches |

Since one-side plating of a stainless steel strip is carried out while the other side not to be plated is covered with a protective film, the other side not to be plated remains intact during electroplating without undergoing scratches due to contact with the rolls or discoloration caused by chemical treating solutions. As a result, a one-side plated exterior stainless steel strip having an aesthetic appearance can be produced at low cost.

The welded pipe-making stainless steel sheet according to the present invnetion has substantially the same structure as the exterior stainless steel sheet. The metal coating layer is subject to sacrificial dissolution whereas the stainless steel is given sacrificial corrosion prevention. Even if the metal coating layer is partially lost as a result of sacrificial dissolution or welding, the thus exposed stainless steel surface or welded portion is still given sacrificial corrosion prevention by virture of the sacrificial dissolution of the remaining metal coating layer. The entire welded pipe thus exhibits a markedly extended corrosion resistant life.

Since substantially the same discussion as made for the exterior stainless steel sheets applies to the welded pipe-making stainless steel sheets, the description about the latter is rather limited to different factors.

We have examined the corrosion resistance of a pipe formed from a stainless steel sheet having a metal coating layer deposited thereon. Samples were prepared by depositing on one surface of SUH 409 stainless steel sheets a thin coating layer of metal materials including Zn, Zn alloy, Al, Al alloy, and Mg alloy, and welding the mating edges by TIG welding or high frequency welding. The samples were subjected to a weathering test for one year and a salt spray test (SST) for one cycle, spraying water containing 5% NaCl for 16 hours and allowing the samples to stand for 8 hours at 35° C. Those samples having a thin coating layer of metal materials electrochemically less noble than the stainless steel on one surface exhibited excellent corrosion resistance at a welded portion. Another series of pipe samples were prepared from a SUH 409 (stainless steel) sheet having a similar thin metal coating layer by roll forming the sheet such that the metal coated surface faced outside and welding the mating edges by TIG welding or high frequency welding. They were also subjected to a weathering test and a salt spray test (SST). Those samples having a thin coating layer of metal materials electrochemically less noble than the stainless steel exhibited outstandingly higher corrosion resistance at a welded portion than those samples having no such thin metal coating layer.

SUH 409 is heat-resistant steel and not classified in its precise meaning as stainless steel, but treated generally as stainless steel.

The metal coating layer adhered to a stainless steel sheet is of at least one member selected from the group consisting of metal materials electrochemically less noble than the stainless steel, specifically, zinc and a zinc alloy in the case of welded pipe-making stainless steel sheets.

For the welded pipe-making stainless steel sheets, it is imporant that the metal coating layer deposited on the steel be selected from Zn and Zn alloys among other metal materials previously described as being preferred for coating on the exterior stainless steel sheets. A choice of Zn or Zn alloy promises the workability of a welded pipe formed from the coated stainless steel sheet. More particularly, those welded pipes formed from steel sheets having a metal coating layer of Zn or Zn alloy have an increased enlargement ratio, good workability at a weld joint comparable to that of a welded pipe formed from a steel sheet having no metal coating layer, and experience no difficulty in welding. On the other hand, those welded pipes formed from SUH 409 steel sheets having a metal coating layer of Al, Al alloy or Mg alloy have a substantially lower layer enlargement ratio and poorer ductility at a weld joint than welded pipes from SUH 409 steel sheets having no metal coating layer.

The reason why the welded pipes formed from steel sheets having a metal coating layer of Al, Al alloy or Mg alloy are reduced in workability is not well understood. It is supposed that the zinc in the Zn or Zn alloy coating layer is melted, evaporated and thus lost during welding into a pipe whereas aluminum or magnesium forms a brittle intermetallic compound.

The type of zinc alloys used for welded pipe-making stainless steel sheets is not particularly limited because the required properties such as corrosion resistance and workability at a weld joint are maintained as long as they are Zn base alloys. Examples of the zinc alloys include Zn-Ni, Zn-Fe, and Zn-Mn alloys. The proportion of alloying elements in the Zn alloys is not particularly limited because Ni, Fe and Mn in the Zn alloys do not form any intermetallic compound with stainless steel during welding.

The total thickness of the metal coating layer ranges from 1 to 50 μm in the case of the welded pipe-making stainless steel sheets. With a metal coating layer of less than 1 μm thick, rust tends to generate at a weld joint of a welded pipe. Welded pipe-making stainless steel sheets having a metal coating layer of more than 50 μm thick are undesirable because the metal coating layer tends to separate during working into a pipe irrespective of the coating method.

EXAMPLES P1–P26

Preparation of welded pipe from coated stainless steel sheet

SUH 409 and SUS 410 stainless steel sheets having a thickness of 1 mm were used. The sheets were coated on one surface with various metal layers by electroplating, hot dipping, vacuum deposition, and plasma spraying (using argon gas) as shown in Table 12, obtaining welded pipe-making stainless steel sheets. Each sheet was roll formed into a round shape such that the coated surface faced outside and then welded along the mating edges by TIG or high frequency (HF) welding into a pipe having an outside diameter of 42.7 mm.

Evaluation

Evaluation was made for the workability of the steel sheets, the corrosion resistance of the pipes, and the workability of the steel sheets and the pipes at weld joints. The results are also shown in Table 12.

(i) Workability of steel sheet

An Erichsen cup drawing test was carried out according to JIS Z 2247.

(ii) Corrosion resistance of pipe

The pipes were subjected to a weathering test at the seashore for one year and a salt spray test (SST), one cycle of the SST consisting of spraying water containing 5% NaCl at 35° C. for 16 hours and allowing the samples to stand for 8 hours. The inside and outside surfaces and weld joint of each pipe were visually observed to evaluate according to the following criteria.

| Weathering test | |
|---|---|
| Rating | Rust (red rust) observed |
| A: | substantially no |
| B: | less |
| C: | moderate |
| D: | much |
| **SST** | |
| Rating | Rust (red rust) observed |
| A: | substantially no |
| B: | less |
| C: | moderate |

-continued

| | |
|---|---|
| D: | much |

(iii) Workability of steel sheet and pipe

The steel sheets welded were subjected to a bending test according to JIS Z 2204. A sheet was bent up to a bending angle of about 170° by a forced bending procedure such that the coating layer or face bead side became outside upon bending. Occurrence of cracks was visually observed and rated as follows.

O: no crack

X: cracked

The pipes were subjected to an enlarging or expanding test. A cone having an apex angle of 60° was placed at the end of a pipe. The pipe was forced against the cone at room temperature to expand the pipe end portion into a flared shape to the limit above which cracks occurred in the pipe wall. The outside diameter of the thus expanded pipe end is divided by that of the pipe before expansion to determine an enlargement ratio.

TABLE 12

| Example | Stainless steel | Coating method | Coating metal | Welding method | Coating thickness (μm) | Workability Erichsen value (mm) | Corrosion resistance | | Workability at weld joint | |
|---|---|---|---|---|---|---|---|---|---|---|
| | | | | | | | Weathering | SST | Bending test | Enlargement |
| P1 | SUH 409 | electro-plating | Zn | TIG | 16 | 10.7 | A | A | O | 1.40 |
| P2 | SUH 409 | electro-plating | Zn | HF | 16 | 10.7 | A | A | O | 1.40 |
| P3 | SUH 409 | electro-plating | Zn-13% Ni | TIG | 9 | 10.6 | A | A | O | 1.45 |
| P4 | SUH 409 | electro-plating | Zn-13% Ni | HF | 9 | 10.6 | A | A | O | 1.45 |
| P5 | SUH 409 | electro-plating | Zn-13% Fe | TIG | 11 | 10.6 | A | A | O | 1.40 |
| P6 | SUH 409 | electro-plating | Zn-13% Fe | HF | 11 | 10.6 | A | A | O | 1.40 |
| P7 | SUH 409 | electro-plating | Zn(L) + Zn-13% Ni(U)** | TIG | 7(L) + 8(U) | 10.7 | A | A | O | 1.45 |
| P8 | SUH 409 | electro-plating | Zn(L) + Zn-13% Ni(U)** | HF | 7(L) + 8(U) | 10.7 | A | A | O | 1.45 |
| P9* | SUH 409 | electro-plating | Zn | TIG | <0.1 | 10.6 | B | C | O | 1.40 |
| P10* | SUH 409 | electro-plating | Zn | HF | <0.1 | 10.6 | B | C | O | 1.40 |
| P11* | SUH 409 | vacuum deposition | Al | TIG | 12 | 10.5 | A | A | X | 1.15 |
| P12* | SUH 409 | vacuum deposition | Al | HF | 12 | 10.5 | A | A | X | 1.10 |
| P13 | SUH 409 | plasma spraying | Zn | TIG | 6 | 10.6 | A | A | O | 1.40 |
| P14 | SUH 409 | plasma spraying | Zn | HF | 6 | 10.6 | A | A | O | 1.40 |
| P15* | SUH 409 | no coating | — | TIG | — | 10.6 | D | D | O | 1.40 |
| P16* | SUH 409 | no coating | — | HF | — | 10.6 | D | D | O | 1.40 |
| P17 | SUS 410 | electro-plating | Zn | TIG | 12 | 10.1 | A | A | O | 1.35 |
| P18 | SUS 410 | electro-plating | Zn | HF | 12 | 10.1 | A | A | O | 1.35 |
| P19 | SUS 410 | electro-plating | Zn-38% Mn | TIG | 9 | 10.2 | A | A | O | 1.35 |
| P20 | SUS 410 | electro-plating | Zn-38% Mn | HF | 9 | 10.2 | A | A | O | 1.35 |
| P21 | SUS 410 | plasma spraying | Zn | TIG | 7 | 10.0 | A | A | O | 1.35 |
| P22 | SUS 410 | plasma spraying | Zn | HF | 7 | 10.0 | A | A | O | 1.35 |
| P23 | SUS 410 | hot dipping | Al | TIG | 11 | 10.2 | A | A | X | 1.05 |
| P24 | SUS 410 | hot dipping | Al | HF | 11 | 10.2 | A | A | X | 1.10 |
| P25 | SUS 410 | no coating | — | TIG | — | 10.1 | D | D | O | 1.35 |
| P26 | SUS 410 | no coating | — | HF | — | 10.1 | D | D | O | 1.35 |

*comparative examples
**Zn is as lower layer and Zn-Ni is as upper layer

As evident from Table 12, the samples falling within the scope of the present invention are markedly improved in corrosion resistance without reducing the workability of sheet material and the workability at a weld joint. Even if the coating layer is lost at a weld joint during welding, corrosion resistance is maintained high, particularly at the weld joint. Those samples having a coating layer of less than 0.1 μm thick (Examples P9 and P10) and those samples having no coating layer (Examples P15, P16, P25 and P26) exhibit insufficient corrosion resistance. Further, those samples having a coating layer of Al (Examples P11, P12, P23 and P24) are markedly improved in corrosion resistance without sacrificing the workability of sheet material, but noticeably reduced in workability at a weld joint due to embrittlement of the weld joint.

The exterior stainless steel sheet of the present invention having at least one coating layer of Al, Al alloy, Zn or Zn alloy formed on one surface thereof to a thickness of 0.1 to 70 μm, preferably 1 to 70 μm is excellent in workability and weatherability at its uncoated surface. Particularly when the steel is a bright annealed stainless steel sheet, the weatherability of the uncoated surface is markedly improved. Additionally, the Al or Zn thinly coated steel sheet is improved in spot weldability and effective in preventing cosmetic corrosion of an automobile body such as a lacquered steel strip to which the coated steel sheet is attached. The exterior stainless steel strips find a wide variety of applications as inexpensive exterior members for automobiles and buildings.

The welded pipe-making stainless steel sheet of the present invention having at least one coating layer of Zn or Zn alloy formed on one surface thereof to a thickness of 0.1 to 50 μm, preferably 1 to 50 μm is excellent in corrosion resistance and workability, and exhibits improved workability and corrosion resistance even after it is formed into a welded pipe. A stainless steel sheet having previously formed a surface coating layer is shaped and welded into a pipe which maintains excellent corrosion resistance and workability. Thus a surface coated pipe can be prepared from the stainless steel sheet of the invention in high yield and good economy as compared with the prior art process wherein an uncoated stainless steel sheet is shaped and welded into a pipe before a surface coating layer is formed thereon.

We claim:

1. A welded stainless steel pipe for automotive conduits prepared by providing a stainless steel sheet comprising a stainless steel substrate having a Vickers hardness of up to 220, and at least one coating layer formed on one surface of the steel substrate from at least one member selected from the group consisting of zinc and zinc alloys to a thickness of 0.1 to 50 μm, roll forming the stainless steel sheet such that the coated surface faces outside, and welding the roll formed stainless steel sheet along its mating edges to produce the welded pipe.

2. The welded stainless steel pipe of claim 1 wherein said zinc alloys are selected from the group consisting of Zn-Ni alloys, Zn-Fe alloys, and Zn-Mn alloys.

3. The welded stainless steel pipe of claim 1 wherein said stainless steel sheet further comprises a chromate layer deposited on said coating layer to a thickness of up to 1 μm.

4. A welded stainless steel pipe for automotive conduits comprising stainless steel having a Vickers hardness of up to 220, a longitudinally extending welded portion, an uncoated inner surface, and an outer surface having a coating layer formed from at least one member selected from the group consisting of zinc and zinc alloys of 0.1 to 50 microns thickness, said coating layer on the outer surface being formed before the welding of the stainless steel pipe.

5. The pipe of claim 4 wherein the coating layer has a thickness of 1 to 50 microns.

6. The welded stainless steel pipe of claim 4 wherein said zinc alloys are selected from the group consisting of Zn-Ni alloys, Zn-Fe alloys, and Zn-Mn alloys.

7. The welded stainless steel pipe of claim 4 wherein the pipe further comprises a chromate layer on said coating layer of a thickness of up to 1 micron.

* * * * *